United States Patent [19]

Dahl

[11] 3,934,510

[45] Jan. 27, 1976

[54] PROXIMITY FUSE

[75] Inventor: Bjørn Dahl, Kongsberg, Norway

[73] Assignee: A/S Kongsberg Vapenfabrik, Kongsberg, Norway

[22] Filed: Mar. 25, 1974

[21] Appl. No.: 454,611

Related U.S. Application Data

[63] Continuation-in-part of Ser. No. 340,034, March 12, 1973, Pat. No. 3,802,343.

[30] Foreign Application Priority Data

Mar. 26, 1973 Norway ..... 1223/73

[52] U.S. Cl. ..... 102/70.2 P; 343/7 PF

[51] Int. Cl.[2] ..... F42C 13/04

[58] Field of Search ..... 102/70.2 P; 343/7 PF

[56] References Cited

UNITED STATES PATENTS

| | | | |
|---|---|---|---|
| 2,907,023 | 9/1959 | Skinner | 102/70.2 P |
| 3,326,130 | 6/1967 | Baker | 102/70.2 P |
| 3,614,781 | 10/1971 | Lichtman | 343/7 PF |
| 3,802,343 | 4/1974 | Dahl | 102/70.2 P |

*Primary Examiner*—Charles T. Jordan

*Attorney, Agent, or Firm*—Holman & Stern

[57] ABSTRACT

A proximity fuse comprising at least two frequency selective amplifiers having different band-pass characteristics and both receiving the same input signals. The first amplifier, having the narrower band-pass filter, will activate a detonator upon receipt of a signal which lies within the pass-band of said filter and which exceeds a given value. If a signal appears in the pass-band of the second amplifier which has the broader pass-band, and said signal exceeds a certain level, the output of said second amplifier will change said level which a signal in said first amplifier must exceed in order to activate the detonator.

The output terminal of said first amplifier is connected to a first level detector, and the output terminal of said second amplifier is connected to a second level detector. Said first and second level detectors are interconnected so that the threshold value of said first level detector is changed in pace with the output signal from said second level detector when the latter detector receives a signal from the second amplifier. In order to prevent the proximity fuse from coming into operation until after a certain time after the launching of a projectile, the second level detector comprises delay elements. These delay elements are also utilized to prolong the change of the threshold value of the first level detector after said signal in the pass-band of said second amplifier has vanished.

8 Claims, 4 Drawing Figures

FIG.1.
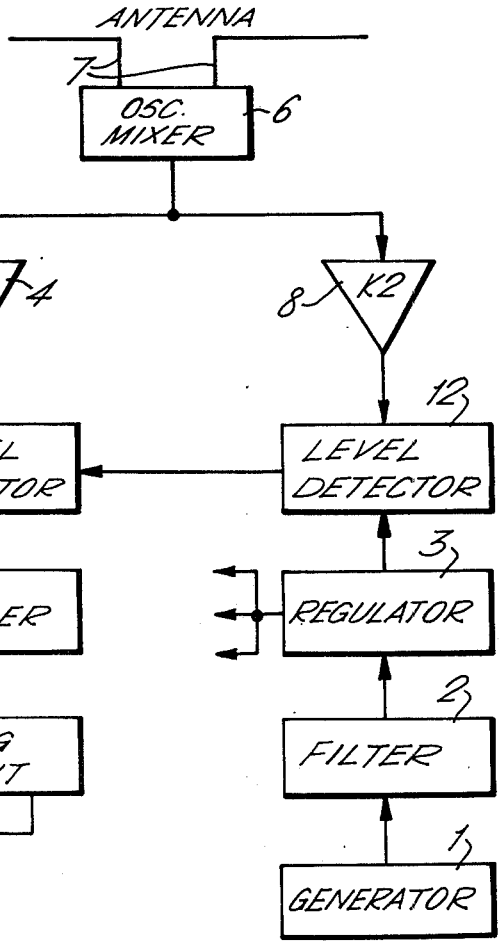
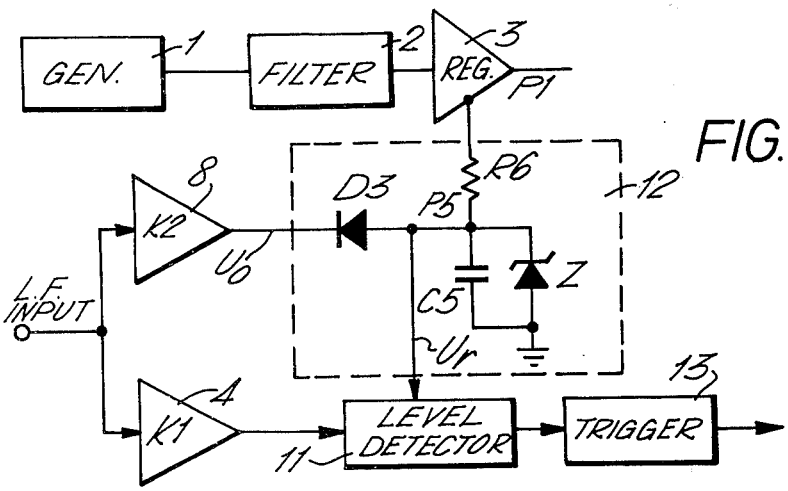
FIG.2.

$U_0$
$U_b$
$U_r$
$t_0$
$t_1$
$t_2$
$t_3$
$t_4$
$t_5$
$t$

GAIN
FREQUENCY
K1
K2

PROXIMITY FUSE

RELATED CASE

This application is a continuation-in-part of U.S. application Ser. No. 340,034, filed Mar. 12, 1973, now U.S. Pat. No. 3,802,343 of Apr. 9, 1974.

BACKGROUND OF THE INVENTION

The prior art discloses a proximity fuse which comprises an electronic circuit which is sensitive to signals in given frequency bands. The circuit, which may be an integral part of a projectile, responds to signals transmitted from the designated target, or it responds to reflected signals originally transmitted from the launched projectile, e.g. doppler signals.

Proximity fuses of this type are, however, subject to the risk of being influenced by spurious signals, which may cause false detonation of the projectile.

SUMMARY OF THE INVENTION

An object of the present invention is to provide a proximity fuse which blocks undesired noise signals that might occur and thereby prevents unintentional detonation of the projectile, and is a further development of the invention which is the subject of patent application Ser. No. 340,034 of the 12th Mar. 1973 now U.S. Pat. No. 3,802,343 of Apr. 9, 1974.

Thus, the present invention relates to a proximity fuse comprising at least two frequency selective amplifiers having different band-pass characteristics and both receiving the same input signals, as disclosed in the specification of said patent application. According to the said application, the primary characteristic feature of the proximity fuse consists in that the first amplifier having the narrower band-pass filter, upon receiving a signal exceeding a given level, activates a detonator, while the second amplifier, having the broader band-pass filter, blocks the input of the other amplifier if a signal exceeding a given level appears in the band-pass filter of the second amplifier.

It is, however, desirable to prevent unintentional detonation of the projectile by letting the signal which appears in the pass-band of the second amplifier, influence the first amplifier in a more direct manner and at a point in the signal path of the first amplifier, which is closer to the firing circuit.

According to the present invention this may be achieved in the proximity fuse disclosed in the said prior application, which comprises two frequency selective amplifiers having different band-pass characteristics and both receiving the same input signals, and wherein the amplifier having the narrower pass-band activates a detonator upon receiving a signal exceeding a certain level within this pass-band. The proximity fuse according to the invention is primarily characterized in that the amplifier having the broader pass-band, changes the level which a signal in the first amplifier must exceed in order to activate the detonator, if a signal exceeding a certain level appears in the pass-band of the second amplifier.

The desired change may be achieved by connecting a first level detector to the output of the first amplifier, and connecting to the output of the second amplifier, a second level detector connected to the first level detector, the threshold value of the first level detector thereby being changed in pace with the output signal from the second detector when the latter receives signal from the second amplifier.

Arming of the proximity fuse after launching may be prevented by providing the second detector with delay elements consisting of a resistor and a capacitor so that the level detector comes into operation a certain time after the launching of a projectile.

The change of the threshold value of the first level detector has a prolonged effect after the signal in the pass-band of the second amplifier has ceased, due to the fact that the capacitor constituting the delay element of the second level detector is discharged so as to change the threshold value.

In the following the invention will be further described with reference to the drawings, which show a preferred embodiment of the proximity fuse according to the invention.

BRIEF DESCRIPTION OF THE DRAWINGS

FIG. 1 is a block diagram of the main components included in the proximity fuse.

FIG. 2 shows the connection between the components of the second level detector.

DETAILED DESCRIPTION OF PREFERRED EMBODIMENTS

Figure 3:
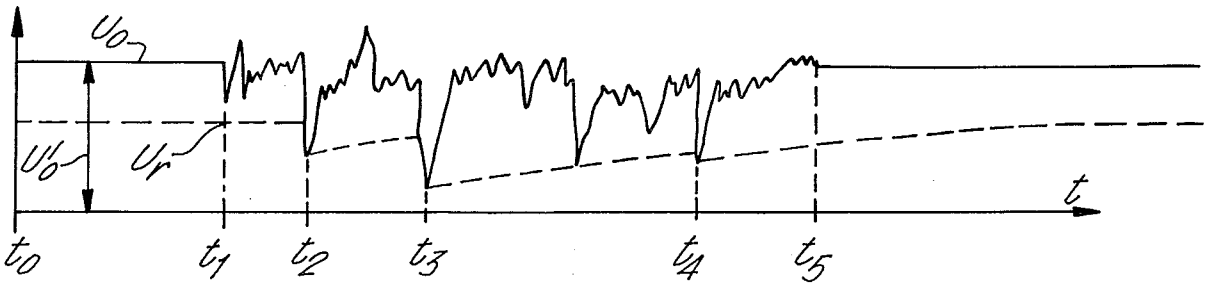
FIG. 3 shows the voltage $U_o$ at the output of the amplifier K2 and the reference voltage $U_r$ which is supplied to the first level detector 11.

In FIG. 1 there is shown an A.C. generator 1 driven for example by a wind turbine (not shown). The generator 1 supplies current to a filter 2. From the filter 2 a smoothed rectified voltage is supplied to a regulator 3, from which the smoothed D.C. voltage feeds the remaining circuit.

When the regulator 3 supplies voltage to the remaining components, high frequency waves are transmitted by an oscillator in the oscillator-mixer-unit 6 via a bipolar antenna 7. The interference between the transmitted and received signals (doppler signals) which is produced in a mixer in the unit 6, is amplified by frequency selective low frequency amplifiers 4 and 8 having different band-pass characteristics. If the signal from the mixer 6 lies within the pass-band of the amplifier 4, a first level detector 11 will pass the first oscillations of the amplified doppler signal on if the same has a given value. The height of detonation or the distance from the target is determined by the setting of the level detector 11 and the low frequency amplifier 4. A trigger 13 closes a firing circuit 5 upon receipt of the first signal from the level detector 11. An electro-mechanical percussion switch 14 is connected in parallel with the firing circuit 5.

If the signal from the mixer 6 includes frequencies which also lie within the pass-band of the amplifier 8, a second level detector 12 will pass the first oscillations of the signal on if the same has a given value. The reference level in the level detector 11 will thereby be changed, and the signal which appears in the first amplifier 4, must exceed a higher threshold value in order to allow the level detector 11 to deliver a signal to the trigger 13.

In FIG. 2 there is shown an example of a level detector 12 consisting of a diode D3, a zener diode Z, a capacitor C5 and a resistor R6, and the electrical course of operation of such a level- or peak-detector 12 and the remaining main components in FIG. 2 will be described in the following.

At the launching of the projectile the turbine (not shown) starts to rotate and drives the generator 1 so that the latter delivers current to the regulator 3 via the filter 2. At P1 the regulator 3 then supplies the correct voltage which at P5 constitutes a reference voltage $U_r$ for the level detector 11 when the capacitor C5 is fully charged. The zener diode Z contributes in placing the reference voltage $U_r$ at a suitable level, and this level determines the threshold value of the level detector 11 which a signal in the amplifier 4 must exceed in order to allow the level detector 11 to pass a signal from the amplifier 4 on to the trigger 13.

The capacitor C5 and the resistor R6 constitute delay elements, and the level detector 11 will only come into operation a certain time T5 after the launching of a projectile, the reference voltage $U_r$ being proportional with the voltage across the capacitor C5. A diode D3 is connected between the point P5 in the peak detector 12 and the amplifier 8, and the connection between the amplifier 8 and the diode D3 will be at the potential $U_o$ when the capacitor C5 is fully charged and no signal is present in the amplifier K2.

The two amplifiers K1 and K2 have an identical design and a common frequency input. This means that the input to the amplifier K2 includes the same signals as the input to amplifier K1. The only difference between the amplifiers resides in their band-pass characteristics.

Figure 4:
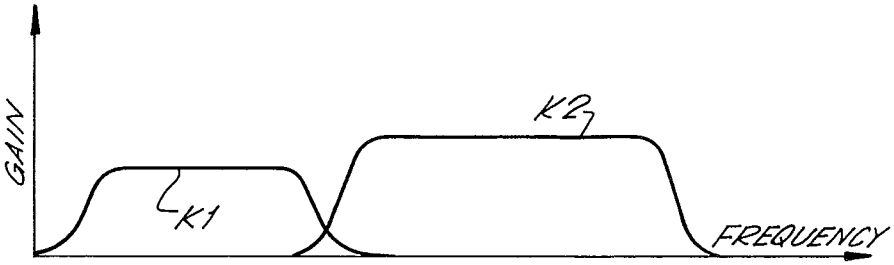
FIG. 4 shows the frequency response curve of amplifiers K1 and K2 respectively.

In FIG. 4 it is shown that the sensitivity of the blocking amplifier K2 is high within a relatively broad frequency band which covers signals having frequencies lying above the pass-band of the doppler amplifier K1. The gain of the doppler amplifier is in this instance chosen to be lower than that of the blocking amplifier.

When the projectile approaches the target, a doppler signal will normally arrive at the common low-frequency input (L-F). The doppler signal is amplified in the doppler amplifier K1, and the level detector 11 lets through the first oscillations of the amplified doppler signal exceeding a given level.

The blocking amplifier has in this case no function as the gain of the same does not cover the doppler frequencies.

The trigger circuit 13 operates the firing circuit 5, which is closed, and the detonation capsule is fired by the discharging of a firing capacitor through a resistor, in the same manner as described in the specification of the prior application. There often appear disturbing signals, such as noise, radar and others, which influence the firing circuit. If these signals have frequency components in the doppler band and also a signal level exceeding a given value, they may cause detonation at an undesired location in the trajectory of the projectile. In most instances, however, such disturbing signals also have frequency components lying beyond the doppler band. Here, the blocking amplifier comes into operation, since it has a high sensitivity within a broad band which covers frequencies lying above the doppler band. The signals are amplified in the blocking amplifier, which amplification, it is true, is parallel to the amplification of signals with doppler frequencies in the doppler amplifier. However, the amplification in the blocking amplifier takes a more rapid course than the amplification in the doppler amplifier. When an amplified blocking signal from the blocking amplifier K2 appears at the output terminal thereof, the output potential $U_o$ will change, for example as illustrated in FIG. 3. In the time interval $t_o$–$t_1$ no output signal is present on the output terminal of the blocking amplifier and the output voltage then has a given reference value $U_o'$. In the time interval $t_1$–$t_5$ disturbing signals appear in the pass-band of the blocking amplifier, and the output voltage from the amplifier K2 will therefore deviate from $U_o'$. This involves that if a signal which exceeds a certain level relatively to the reference voltage $U_o'$, appears in the blocking amplifier K2 as indicated at the points of time $t_2$, $t_3$ and $t_4$ in FIG. 3 a change in the reference voltage $U_r$ of level detector 11 will occur, and a signal which appears in the doppler amplifier K1, must exceed a higher threshold in the level detector 11 in order to permit the detonator to be activated.

The change of the reference voltage $U_r$ and hence of the threshold voltage of the level detector 11 has a prolonged effect even if the signal in the blocking amplifier K2 ceases, because the capacitor C5 is discharged through the diode D3 when a signal with a given value appears in the blocking amplifier K2. Thereby, an effective change of the reference voltage of the level detector is maintained for a certain period of time, thereby avoiding undesired detonation. If, after this time there still remain frequency components outside the doppler band, the change of the reference voltage of the level detector is maintained if the level of the noise signals is above a certain value. At the worst the change will be maintained till the projectile hits the target. However, the blocked proximity fuse will then operate as a sensitive percussion fuse.

In the circuit shown the mutual interference between K1 and K2 may be varied by changing the respective gains and band-widths.

The upper cut-off frequency of K2 is established by means of an internal circuit in the embodiment described above (FIG. 4), but may be reduced or increased as desired, and the effect of K2 with respect to noise is greatest when the pass-bands of K1 and K2 are separated and the gain of K2 is larger than that of K1.

The circuit shown in FIG. 2 is a special version among a plurality of varieties and may easily be adapted to the circuitry which is described in the specification of the main patent, wherein special emphasis is placed on the double security delay of the firing system the first seconds after launching.

In one instant the second amplifier may have a pass-band which covers signals including frequencies lying below, within and above the pass-band range of the first amplifier, the gain of said second amplifier being substantially constant throughout the frequency range but less than the gain within the pass-band of the first amplifier. The gain of the second amplifier is then relatively low in the frequency range of the first amplifier.

Another embodiment of a proximity fuse according to the present invention, may comprise several frequency selective amplifiers receiving the same input signals. One of the amplifiers, having a given narrow pass-band, activates the detonator upon receiving signals having amplitudes above a given level in its pass-band. The remaining amplifiers, which may be equipped with pass-bands covering signals which include frequencies ranging above and below the pass-band of said amplifier, change the level which a signal in this amplifier must exceed in order to activate the detonator.

What I claim is:

1. Proximity fuse, comprising at least two frequency selective amplifiers having different band-pass characteristics and both receiving the same input signals, said first amplifier (K1) including a relatively narrow band-pass filter and being connected to activate a detonator upon receiving a signal exceeding a given level within the pass-band thereof, said second amplifier (K2) including a relatively broad band-pass filter and being adapted to change the level which a signal in the first amplifier (K1) must exceed in order to activate the detonator, if a signal exceeding a certain level appears in the pass-band of the second amplifier.

2. Proximity fuse as claimed in claim 1, characterized in that the output terminal of said first amplifier (K1) is connected to a first level detector (11), that to the output terminal of said second amplifier (K2) there is connected a second level detector (12) which is connected to said first level detector (11), so that the threshold value of said first level detector (11) is changed in pace with the output signal ($U_o$) from said second level detector when the latter receives a signal from said second amplifier (K2).

3. Proximity fuse as claimed in claim 2, characterized in that said second level detector (12) comprises delay elements consisting of a resistor (R6) and a capacitor (C5) so that said first level detector (11) comes into operation a certain time (T1) after the launching of a projectile.

4. Proximity fuse as claimed in claim 3, characterized in that the change of the threshold value of said first level detector (12) has a prolonged effect after the signal in the pass-band of said second amplifier (K2) has ceased, by discharging the capacitor (C5) which constitutes the delay element of said second level detector so as to change the threshold value.

5. Proximity fuse as claimed in claim 1, characterized in that the pass-band of said second amplifier (K2) covers signals including frequencies lying below, within and above the pass-band range of said first amplifier, the gain of said second amplifier being substantially constant throughout the frequency range but less than the gain within the pass-band of said first amplifier.

6. Proximity fuse as claimed in claim 5, characterized in that the gain of said second amplifier is relatively low in the frequency range of said first amplifier (K1).

7. Proximity fuse as claimed in claim 1, characterized in that the pass-band of said second amplifier (K2) substantially covers only signals including frequencies above the upper cut-off frequency of said first amplifier.

8. Proximity fuse as claimed in claim 7, characterized in that the gain of said second amplifier is higher than that of said first amplifier.

* * * * *